US008875785B2

(12) United States Patent
Coles

(10) Patent No.: US 8,875,785 B2
(45) Date of Patent: Nov. 4, 2014

(54) SYSTEM AND METHOD FOR CORRECTING DOWNHOLE SPEED

(75) Inventor: Randolph S. Coles, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/236,044

(22) PCT Filed: Jul. 16, 2012

(86) PCT No.: PCT/US2012/046867

§ 371 (c)(1),
(2), (4) Date: Jan. 29, 2014

(87) PCT Pub. No.: WO2014/014441

PCT Pub. Date: Jan. 23, 2014

(65) Prior Publication Data

US 2014/0202691 A1 Jul. 24, 2014

(51) Int. Cl.
*E21B 47/00* (2012.01)
*E21B 47/04* (2012.01)

(52) U.S. Cl.
CPC ..... *E21B 47/00* (2013.01); *E21B 47/04* (2013.01)
USPC ..... 166/255.1; 166/250.01

(58) Field of Classification Search
USPC ..... 166/255.1, 53, 250.01, 254.2, 297; 702/6
See application file for complete search history.

(56) References Cited

U.S. PATENT DOCUMENTS 4,252,190 A 2/1981 Jageler et al.
4,597,440 A 7/1986 Pottier
4,662,209 A 5/1987 Brown
5,522,260 A 6/1996 Chappellat et al.
6,145,378 A 11/2000 McRobbie et al.
6,148,263 A * 11/2000 Brooks et al. ..... 702/6
6,394,184 B2 * 5/2002 Tolman et al. ..... 166/281

(Continued)

FOREIGN PATENT DOCUMENTS

WO WO2009143469 11/2009
WO WO2012021126 2/2012
WO WO2012082302 6/2012

OTHER PUBLICATIONS

International Search Report, Written Opinion for PCT/US2012/046867 dated Mar. 25, 2013, issued by the European Patent Office, Authorized Officer Nathalie Kermani, 11 pages.

(Continued)

*Primary Examiner* — Daniel P Stephenson
(74) *Attorney, Agent, or Firm* — Anthony Iannitelli; Fish & Richardson P.C.

(57) ABSTRACT

A method of correcting a downhole speed of a tool string moving in a wellbore. In some implementations, the method includes obtaining a downhole tool speed with an accelerometer, moving the tool string past at least two casing collars, calculating the average tool speed over the interval between collars, and comparing the downhole tool speed as calculated using the data from the accelerometer to the average tool speed calculated based on the time and the interval between the casing collars, determining a correction factor, and determining a corrected downhole tool speed. A system includes a casing collar locator, an accelerometer, and a processor adapted to compare the downhole tool speed calculated using data from the accelerometer to the average downhole tool speed calculated using the time and casing collar location, determine a correction factor and determine a corrected downhole tool speed.

25 Claims, 4 Drawing Sheets

(56) References Cited

U.S. PATENT DOCUMENTS

| | | | | |
|---|---|---|---|---|
| 6,618,675 | B2 | 9/2003 | Strickland | |
| 6,662,645 | B2 | 12/2003 | Brewer | |
| 6,704,655 | B2 | 3/2004 | Kelly | |
| 6,896,056 | B2 | 5/2005 | Mendez et al. | |
| 7,142,985 | B2 | 11/2006 | Edwards | |
| 7,225,879 | B2 | 6/2007 | Wylie et al. | |
| 7,350,410 | B2 | 4/2008 | Ekseth et al. | |
| 7,363,967 | B2 * | 4/2008 | Burris et al. | 166/66 |
| 7,475,486 | B1 | 1/2009 | Fitzgerald et al. | |
| 7,696,901 | B2 | 4/2010 | Wilson et al. | |
| 8,037,934 | B2 | 10/2011 | Strickland | |
| 8,061,443 | B2 | 11/2011 | Hall et al. | |
| 2009/0107725 | A1 | 4/2009 | Christy et al. | |
| 2009/0129942 | A1 | 5/2009 | Dorado et al. | |
| 2010/0300685 | A1 | 12/2010 | Del Campo et al. | |
| 2013/0062055 | A1 * | 3/2013 | Tolman et al. | 166/250.01 |
| 2013/0255939 | A1 * | 10/2013 | Kumaran et al. | 166/255.1 |
| 2014/0131035 | A1 * | 5/2014 | Entchev et al. | 166/255.1 |

OTHER PUBLICATIONS

International Search Report, Written Opinion for PCT/US2012/046857 dated May 29, 2013, issued by the European Patent Office, Authorized Officer Nathalie Kermani, 22 pages.

Seals et al., "Automated Controls for Pump Down Operations," International Application No. PCT/US10/44999, filed Aug. 10, 2010, 49 pages.

* cited by examiner 200
211
220
231
221
241
243
251

SYSTEM AND METHOD FOR CORRECTING DOWNHOLE SPEED

TECHNICAL FIELD

The present disclosure relates to systems, assemblies, and methods for conveying perforating and/or logging tools (hereinafter referred to as a "tool string") in a wellbore where adverse conditions may be present to challenge downward movement of the tool string in the wellbore.

BACKGROUND

In oil and gas exploration it is important to obtain diagnostic evaluation logs of geological formations penetrated by a wellbore drilled for the purpose of extracting oil and gas products from a subterranean reservoir. Diagnostic evaluation well logs are generated by data obtained by diagnostic tools (referred to in the industry as logging tools) that are lowered into the wellbore and passed across geologic formations that may contain hydrocarbon substances. Examples of well logs and logging tools are known in the art. Examples of such diagnostic well logs include Neutron logs, Gamma Ray logs, Resistivity logs and Acoustic logs. Logging tools frequently are used for log data acquisition in a wellbore by logging in an upward (up hole) direction, from a bottom portion of the wellbore to an upper portion of the wellbore. The logging tools, therefore, need first be conveyed to the bottom portion of the wellbore. In many instances, wellbores can be highly deviated, or can include a substantially horizontal section. Such wellbores make downward movement of the logging tools in the wellbore difficult, as gravitational force becomes insufficient to convey the logging tools downhole.

SUMMARY

The present disclosure relates to a method and system for correcting the downhole speed at which perforating and/or logging tools (hereinafter referred to as a "tool string") are moving in a wellbore. The disclosed systems, assemblies, and methods can reduce risk of damage to the tool string and increase speed and reliability of moving the tool string into and out of wellbores. For example, certain wells can be drilled in a deviated manner or with a substantially horizontal section. In some conditions, the wells may be drilled through geologic formations that are subject to swelling or caving, or may have fluid pressures that make passage of the tool string unsuitable for common conveyance techniques. The present disclosure overcomes these difficulties and provides several technical advances.

The present disclosure relates generally to a system and method for correcting the speed of tool strings that are being lowered into or pulled out of a wellbore. The tool strings may be connected to the lower end of an electric wireline or slickline cable that is spooled off a truck located at the surface. As used herein the terms "cable" and "line" and "wireline" are used interchangeably and unless described with more specificity may include an electric wireline cable or a slickline cable.

In other implementations the tool string may be lowered into the wellbore via a drill pipe string, a coiled tubing string, and a conventional tubing string.

The subject method and system are used in some implementations in a cased wellbore or in other implementations are applicable in a partially cased wellbore. The tool string is adapted for use in highly deviated wellbores wherein it is a known practice to pump fluid from the surface behind a tool string to assist the tool in moving down the deviated wellbore.

General background of pump down tool technology is known in the art and is disclosed in pending application PCT/US/2010/44999. The automated pump-down system described in the afore referenced PCT patent application depends on sensor data to provide line tension and line speed. Typically, these readings would come from sensors and calculations done at the surface as prior art pump down operations do not include a tool string that has the capability to transmit this information from the tool string. Using surface data to describe events happening in the wellbore is not optimum due to the delay in the response of the sensors at the surface as well as the inaccuracies caused by the effect of wellbore conditions on the readings. Changes in tension at the cable head of the tool string and real tool string speed would not be instantaneously measured due to dampening effects of stretching of the wireline cable and different wellbore fluids. Accuracy of those measurements would also be affected by cable stretch, wellbore fluids, and well geometry.

If the pump pressure of the fluid behind the tool string is too great it may result in excessive downhole tension on the cable head that will result in breaking the cable or pulling the cable out from the cable head. It is desirable to control the pump pressure or line speed of the cable to keep the tension in the cable within safe parameters.

In some implementations, the down tool string of the present disclosure includes a device that measures the tension in the cable at the cable head and transmits that data as an analog signal to the surface via an electric wireline cable or other transmission means, and uses that data to control pumps and/or line speed.

Additionally, in some implementations the tool string of the present disclosure may include a device that calculates the speed of the downhole tool string at the cable head and transmits that data as an analog signal. (Examples of such devices include an accelerometer and/or a casing collar locator.)

Additionally, in some implementations a casing collar locator may be used to correct the downhole speed calculations.

In a first aspect, a method of correcting a downhole speed of a tool string moving in a wellbore includes inserting a tool string into a proximal upper end of the wellbore, said tool string includes a cable head connected at a first end to a cable, a casing collar locator, an accelerometer, and at least one downhole tool selected from the group consisting of a logging tool and a perforating tool, spooling out cable at the surface allowing the tool string to move into the wellbore, obtaining a downhole tool speed with an accelerometer and providing said data to a processor that calculates the downhole speed of the tool string based on the accelerometer data, moving the tool string past at least two casing collars and sending data to the processor including the depth of each of the collars and time that the casing collar locator passes each of the casing collars, calculating by the processor the average tool speed over the interval between collars, and comparing the downhole line speed as calculated by the processor using the data from the accelerometer to the average tool speed calculated by the processor based on the time and casing collar.

Various implementations can include some, all, or none of the following features. The method can also include determining by the processor that the average calculated downhole tool speed is less than or greater than the measured line speed, determining a correction factor, and determining a corrected downhole tool speed. The method can include determining by the processor that the casing collar is recorded at a measured depth where expected, determining a correction factor, and determining a corrected downhole tool speed. The method can include determining by the processor that the casing collar at calculated depth is shallower/deeper than expected, determining a correction factor, and determining a corrected downhole tool speed. The correction factor can be calculated using measured casing collar depth, time, and calculated casing collar depth. The correction factor can be determined in part using a calculation of a gravity coefficient given by the equation: gravity=pow(pow(AccX, 2)+pow(AccY, 2)+pow(AccZ, 2), 0.5). The correction factor can be determined in part using a calculation of downhole tool given by the equation: speed=0.5*pow(gravity, 2.0)*pow(intTime, 2.0).

In a second aspect, a method of correcting a downhole speed of a tool string moving in a wellbore includes inserting a tool string into a proximal upper end of the wellbore, said tool string including a cable head connected at a first end to a cable, a casing collar locator, and at least one downhole tool selected from the group consisting of a logging tool and a perforating tool, spooling out cable at the surface allowing the tool string to move into the wellbore, moving the tool string past at least two casing collars and sending data to a processor including the depth of each of the collars and time that the casing collar locator passes each of the casing collars; and calculating the average tool speed over the interval between collars.

Various implementations can include some, all, or none of the following features. The method can include determining that an average calculated downhole tool speed is less than or greater than measured line speed, determining a correction factor, and determining a corrected downhole tool speed. The method can include determining that a casing collar is recorded at a measured depth where expected, determining a correction factor, and determining a corrected downhole tool speed. The method can include determining that a casing collar at calculated depth is shallower/deeper than expected, determining a correction factor, and determining a corrected downhole tool speed. The correction factor can be calculated using measured casing collar depth, time, and calculated casing collar depth. The correction factor can be determined in part using a calculation of a gravity coefficient given by the equation: gravity=pow(pow(AccX, 2)+pow(AccY, 2)+pow(AccZ, 2), 0.5). The correction factor can be determined in part using a calculation of downhole tool speed given by the equation: speed=0.5*pow(gravity, 2.0)*pow(intTime, 2.0).

In a third aspect, a well logging system includes a tool string including a cable head connected at a first end to a cable, a casing collar locator, an accelerometer, at least one downhole tool selected from the group consisting of a logging tool and a perforating tool, and a processor adapted to receive data from the accelerometer and calculate a downhole tool speed, receive data from the casing collar locator including the depth of each of the collars and time when the casing collar locator passes at least two different casing collars, calculate the average downhole tool speed over the interval between collars, and compare the downhole tool speed as calculated by the processor using the data from the accelerometer to the average downhole tool speed calculated by the processor based on the time and casing collar location.

Various implementations can include some, all, or none of the following features. The system can also include determining that the average calculated downhole tool speed is less than or greater than measured line speed, determining a correction factor, and determining a corrected downhole tool speed. The system can include determining that the casing collar is recorded at a measured depth where expected, determining a correction factor, and determining a corrected downhole tool speed. The system can include determining that the casing collar at calculated depth is shallower/deeper than expected, determining a correction factor, and determining a corrected downhole tool speed. The correction factor can be calculated using measured casing collar depth, time, and calculated casing collar depth. The correction factor can be determined in part using a calculation of a gravity coefficient given by the equation: gravity=pow(pow(AccX, 2)+pow(AccY, 2)+pow(AccZ, 2), 0.5). The correction factor can be determined in part using a calculation of downhole tool speed given by the equation: speed=0.5*pow(gravity, 2.0)*pow(intTime, 2.0).

In a fourth aspect, a well logging system includes a tool string includes a cable head connected at a first end to a cable, a casing collar locator, at least one downhole tool selected form the group consisting of a logging tool and a perforating tool, and a processor adapted to receive data from the casing collar locator including the depth of each of the collars and time when the casing collar locator passes at least two different casing collars, and calculate the average downhole tool speed over the interval between collars.

Various implementations can include some, all, or none of the following features. The system can include determining that the average calculated downhole tool speed is less than or greater than measured line speed, determining a correction factor, and determining a corrected downhole tool speed. The system can include determining that the casing collar is recorded at a measured depth where expected, determining a correction factor, and determining a corrected downhole tool speed. The system can include determining that the casing collar at calculated depth is shallower/deeper than expected, determining a correction factor, and determining a corrected downhole tool speed. The correction factor can be calculated using measured casing collar depth, time, and calculated casing collar depth. The correction factor can be determined in part using a calculation of a gravity coefficient given by the equation: gravity=pow(pow(AccX, 2)+pow(AccY, 2)+pow(AccZ, 2), 0.5). The correction factor can be determined in part using a calculation of downhole tool speed given by the equation: speed=0.5*pow(gravity, 2.0)*pow(intTime, 2.0).

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an inclusive fashion, and thus should be interpreted to mean "including, but not limited to." Unless otherwise specified, any use of any form of the terms "connect," "engage," "couple," "attach," or any other term describing an interaction between elements is not meant to limit the interaction to direct interaction between the elements and may also include indirect interaction between the elements described. Reference to up or down will be made for purposes of description with "up," "upper," "upwardly" or "upstream" meaning toward the surface of the well and with "down," "lower," "downwardly" or "downstream" meaning toward the terminal end of the well, regardless of the wellbore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Disclosed herein are systems and methods for automated monitoring and control of pump down operations. More specifically, the pump rate of a pump unit (or units), the line speed for a logging/perforating (L/P) unit, and the line tension for the L/P unit may be automatically monitored and controlled to enable efficient pump down operations. In at least some embodiments, pump down operations may be based on a predetermined line speed, a predetermined line tension and/or a predetermined pump rate. However, if any of these parameters change during pump down operations, the other parameters will be adjusted automatically. The techniques disclosed herein improve safety of pump down operations by eliminating the possibility of pumping the tools off the end of the wireline cable or other catastrophes.

As a specific example, if the monitored line tension surpasses a desired threshold, the line speed will be automatically reduced to maintain the desired line tension and the pump rate will be reduced in accordance with the amount of change in the line speed. Thereafter, if the monitored line tension drops below the predetermined threshold, the line speed will be automatically increased (up to a desired line speed) and the pump rate will be increased in accordance with the line speed. Similarly, changes in the monitored pump rate during pump down operations may result in automated changes to the line tension and/or line speed of the L/P unit.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
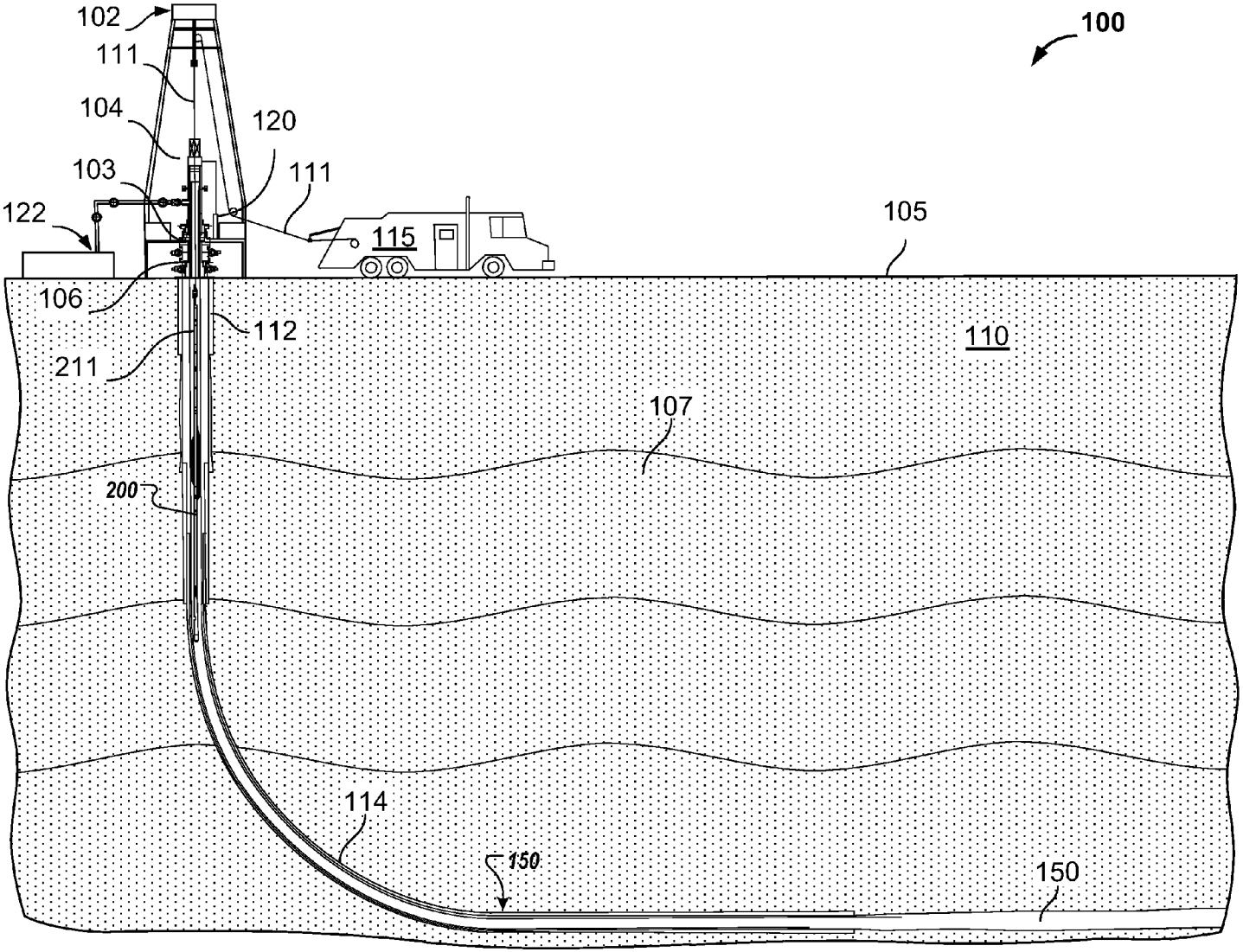
FIG. 1 illustrates an example operation of a logging tool conveying system.

FIG. 1 illustrates an example operation of a tool string 200. The system 100 includes surface equipment above the ground surface 105 and a wellbore 150 and its related equipment and instruments below the ground surface 105. In general, surface equipment provides power, material, and structural support for the operation of the pump down tool string 200. In the embodiment illustrated in FIG. 1, the surface equipment includes a drilling rig 102 and associated equipment, and a data logging and control truck 115. The rig 102 may include equipment such as a rig pump 122 disposed proximal to the rig 102. The rig 102 can include equipment used when a well is being logged or later perforated such as a tool lubrication assembly 104 and a pack off pump 120. In some implementations a blowout preventer 103 will be attached to a casing head 106 that is attached to an upper end of a well casing 112. The rig pump 122 provides pressurized drilling fluid to the rig and some of its associated equipment. A wireline and control truck 115 monitors the data logging operation and receives and stores logging data from the logging tools and/or controls and directs perforation operations. Below the rig 102 is the wellbore 150 extending from the surface 105 into the earth 110 and passing through a plurality of subterranean geologic formations 107. The wellbore 150 penetrates through the formations 107 and in some implementations forms a deviated path, which may include a substantially horizontal section as illustrated in FIG. 1. The wellbore 150 may be reinforced with one or more casing strings 112 and 114.

The tool string 200 may be attached with a cable/wireline 111 via a cable head 211. In some implementations, the conveying process is conducted by pumping a fluid from the rig pump 122 into the upper proximal end of the casing string 112 (or 114) above the tool string 200 to assist, via fluid pressure on the tool string 200, movement of the tool string 200 down the wellbore 150. The pump pressure of the fluid above the tool string 200 is monitored, for example, by the truck 115, because the fluid pressure can change during the conveying process and exhibit patterns indicating events such as sticking of the tool string in the wellbore. As the tool string 200 is pumped (propelled) downwards by the fluid pressure that is pushing behind the tool string 200, the cable 111 is spooled out at the surface by the truck 115.

In some implementations the tool string will have sufficient weight that gravity will convey the tool string down the wellbore without the assistance of pump fluid pressure.

FIGS. 2A to 2E are side views of an example logging tool string 200 applicable to the operations illustrated in FIG. 1. In some implementations the tool string 200 may include various data logging instruments used for data acquisition; for example, a casing collar locator 220, a telemetry gamma ray tool 231, a density neutron logging tool 241, a borehole sonic array logging tool 243, a compensated true resistivity tool array 251, among others as are well known in the art.

The tool string is securely connected with the cable 111 by cable head tool 211. As the tool string 200 is propelled down the bore of the drill string by the fluid pressure, the rate at which the cable 111 is spooled out maintains movement control of the tool string 200 at a desired speed.

Figures 2A, 2B, 2C, 2D, 2E:
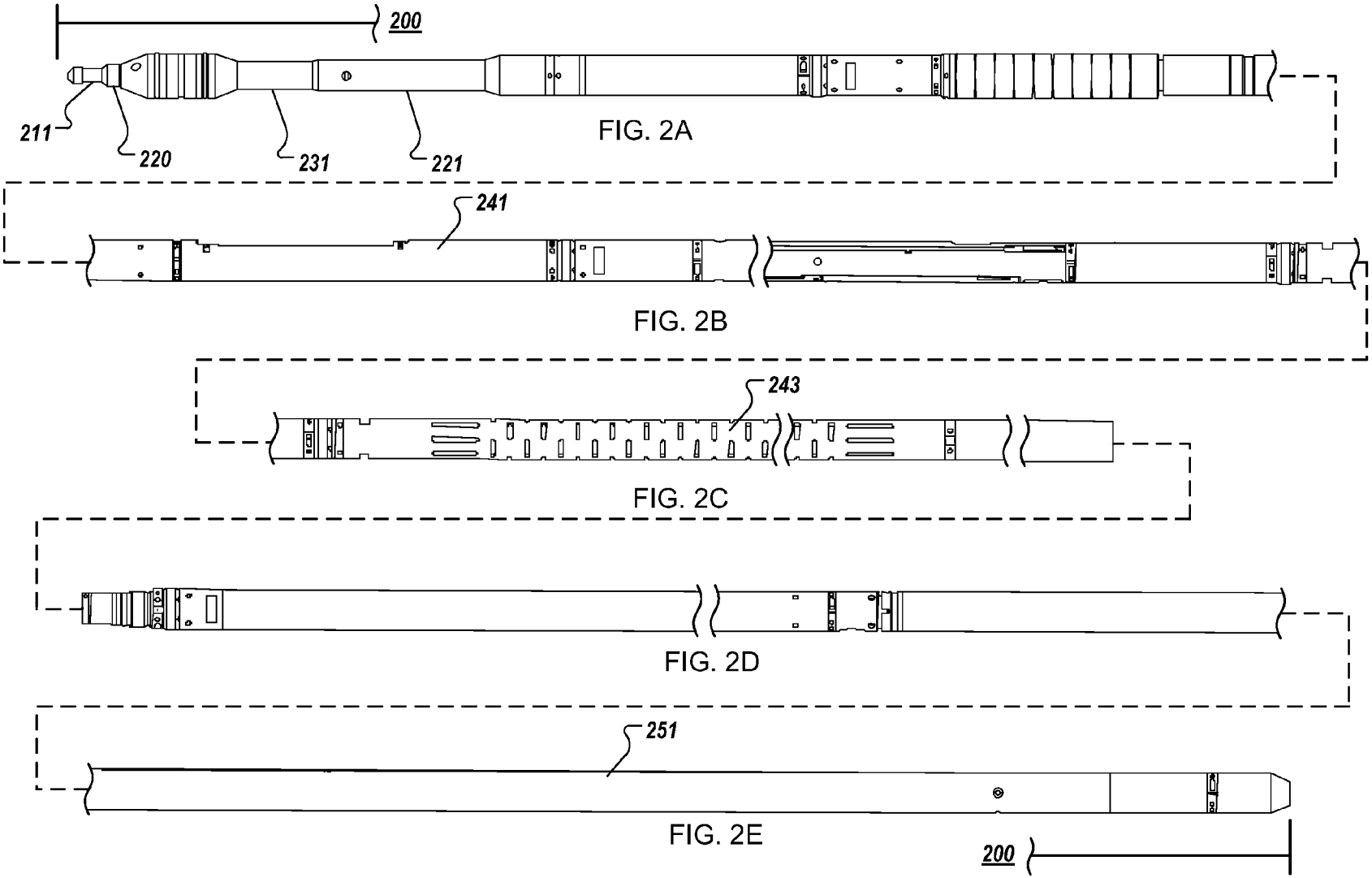
FIGS. 2A to 2E are side views of a logging tool string applicable to the operations illustrated in FIG. 1.
Figure 3:
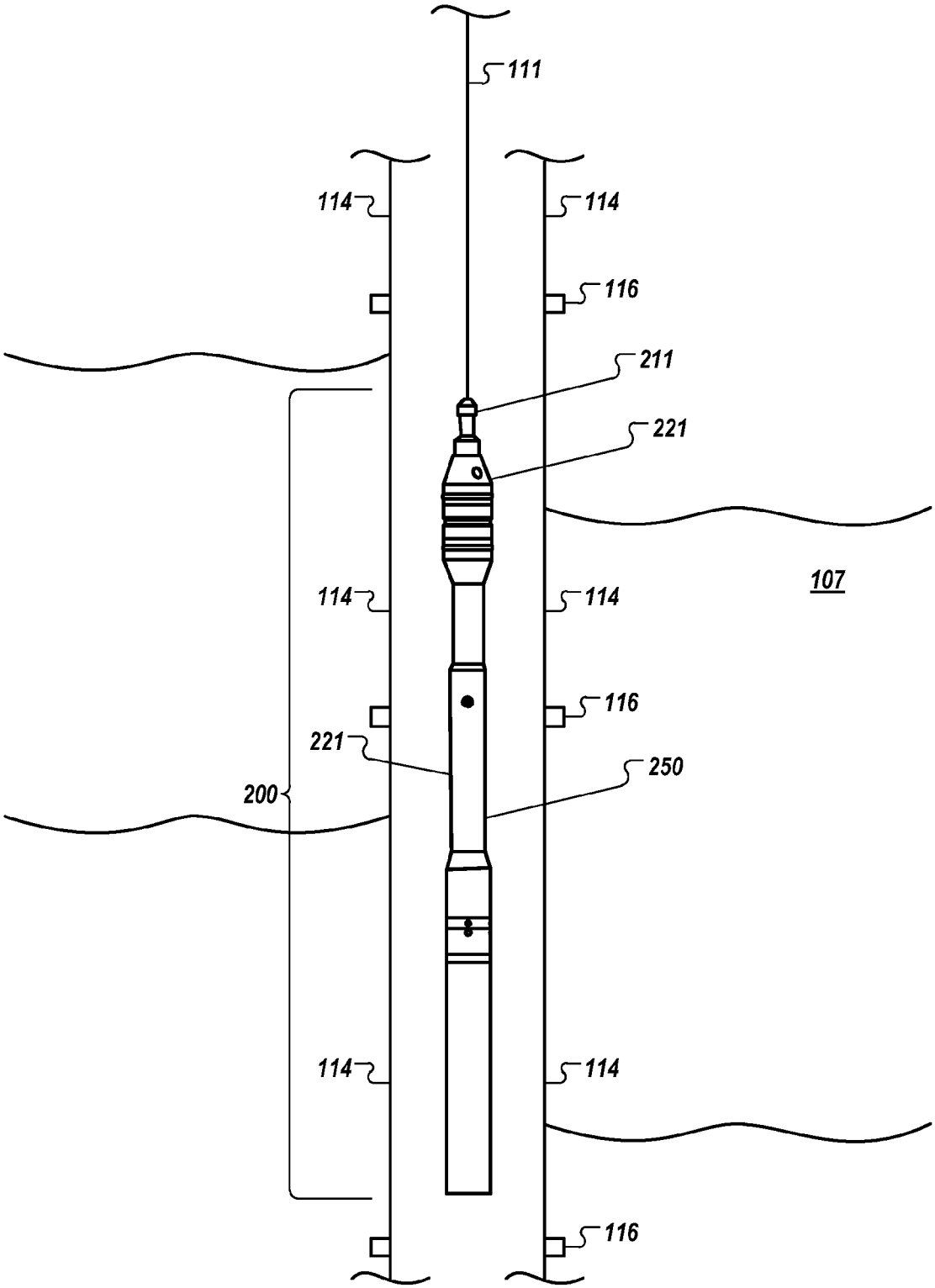
FIG. 3 is a side view of a perforation tool assembly applicable to the operation illustrated in FIG. 1.

In some implementations an accelerometer 221 may be included in the tool string 200 at various locations. One acceptable location is illustrated in FIG. 2A and FIG. 3. In FIG. 2A, the tool string 200 further includes the telemetry gamma ray tool 231. The telemetry gamma ray tool 231 can record naturally occurring gamma rays in the formations adjacent to the wellbore. This nuclear measurement can indicate the radioactive content of the formations.

In FIGS. 2B-2D, the tool string 200 further includes the density neutron logging tool 241 and the borehole sonic array logging tool 243.

In FIG. 2E, the tool string 200 further includes the compensated true resistivity tool array 251. In other possible configurations, the tool string 200 may include other data logging instruments besides those discussed in FIGS. 2A through 2E, or may include a subset of the presented instruments.

Referring to FIG. 3, in other implementations the tool string 200 may include the casing collar locator 221, a firing head and perforating gun 250, as are well known in the art. In some implementations the tool string 200 includes a load cell and/or triaxial accelerometer device.

At the surface there will be a load cell for determining the tension in the cable at the surface and a surface device to measure the line speed the cable is going into the well, as is well known in the art.

Referring to FIG. 3, wherein an exemplary tool string 200 is illustrated inside a casing string 114. Casing collars 116 are couplings that connect two joints of pipe together. The coupling adds mass to the casing string 114 at the connections and the change in mass can be measured. In most cased wellbores, there will be an existing record of the location of the casing collars relative to the actual known depth of most casing collars in the wellbore trajectory. This is typically done by running a log with a Gamma Ray detector and a casing collar locator. The actual known depth of the casing collars is entered into a processor.

As used herein with regard to speed calculations and speed adjustments and corrections factors, the term "measured depth" 412 is used to describe the depth of the casing collar determined using surface measurement of the amount of cable spooled out into the wellbore with or without line tension correction. The term "calculated depth" 413 is used to describe the depth of the casing collar determined using depth information calculated from accelerometers, line tension, and/or other sensors, and may include measured depth in the calculation. The term "expected depth" 416 is used to describe the depth of the casing collar determined based on correlation logs or other references, and is considered to be the true depth or actual known depth.

Figure 4:
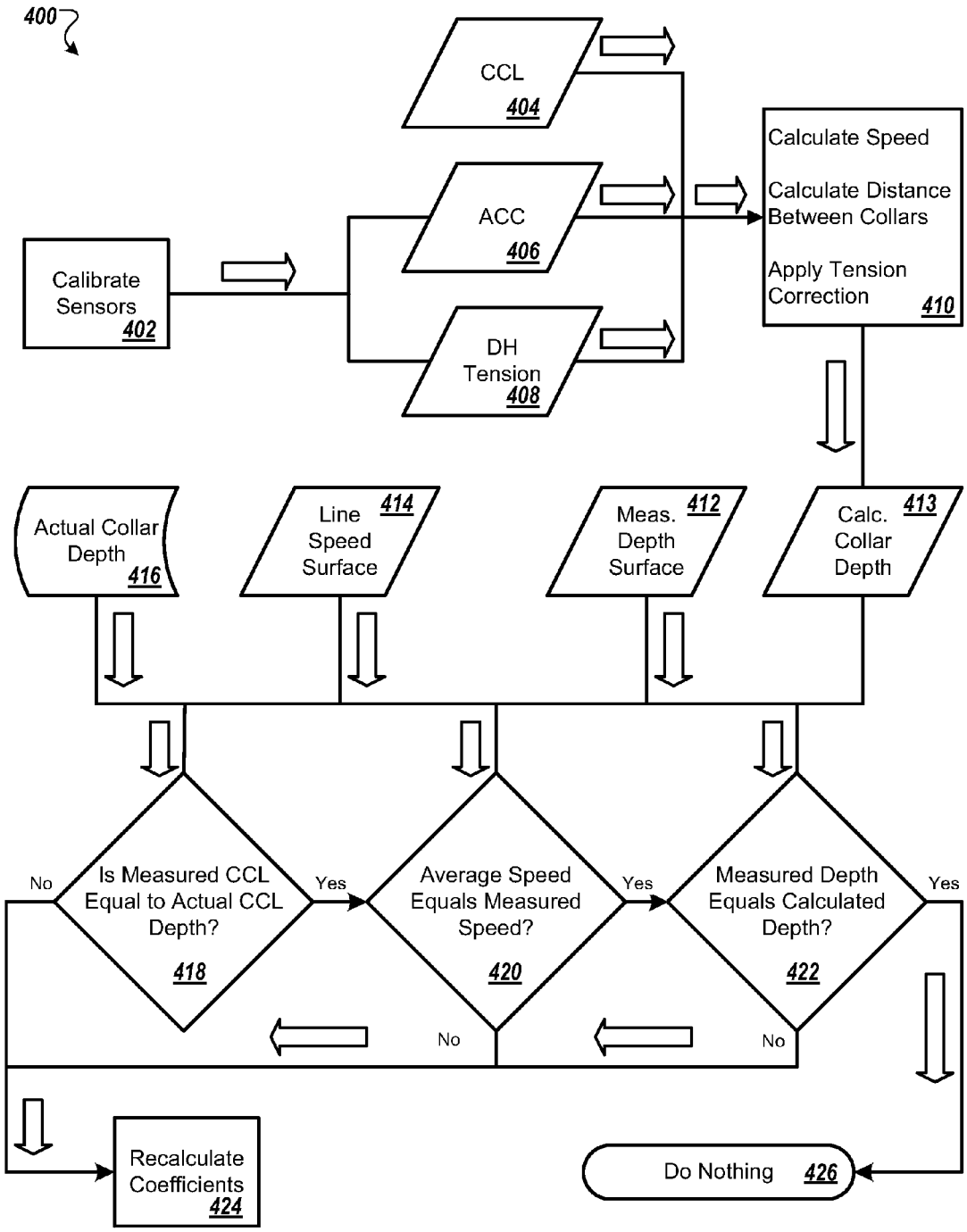
FIG. 4 illustrates a flow diagram of an example tool conveying process.

Referring to FIG. 4, in an example method 400 of operation of the tool string 200, before entering a section of the wellbore that is highly deviated from vertical, a casing collar at a known depth will be recorded and the current depth will be adjusted or the delta will be noted 402. The line will be spooled into the well, the casing collar locator data 404, accelerometer data 406, as well as the downhole line tension data 408 will be transmitted uphole to a surface processor that is part of the system. Downhole tension data 408 is used in speed correction algorithms that use line tension 410. As the tool passes a casing collar the measured depth of the collar 412 will be noted as well as the time. The average tool speed over the interval between collars will be calculated and compared to the average line speed measured at the surface 414 and the average calculated downhole tool speed. The recorded depth 413 of the casing collar will be compared 418 to the expected actual depth 416. The expected actual depth 416 of the casing collar is based on previously recorded measurements used to determine the actual depth of the casing collar. This could be a Gamma Ray/CCL log or some other method of correlating the casing collar depth to the reference depth for the well.

The aforementioned measurements and calculations can be used to determine a course of action across several possible scenarios. In some examples, the calculated downhole tool speed is greater than measured line speed 420, the casing collar is recorded at a measured depth 412 shallower than expected 418, and the casing collar at a calculated depth 413 is found where expected 422. In such examples, the reaction is to do nothing 426, since the downhole calculation is determined to be correct.

In some examples, the calculated downhole tool speed is greater than measured line speed 420, the casing collar is recorded at a measured depth shallower than expected 418, and the casing collar at a calculated depth 413 is found where expected 422. In such examples, the reaction is to do nothing 426, since the downhole calculation is determined to be correct.

In some examples, the calculated downhole line speed is less than measured line speed 420, the casing collar is recorded at a measured depth deeper than expected 418, and the casing collar at calculated depth is found where expected 422. In such examples, the reaction is to do nothing 426, since the downhole calculation is determined to be correct.

In some examples, the average calculated downhole line speed is less than or greater than measured line speed 420, the casing collar is recorded at a measured depth 412 where expected, and the casing collar at calculated depth is shallower/deeper than expected 422. In such examples, the reaction is to do nothing 426, since the downhole calculation is determined to be correct.

In reference to the aforementioned scenario examples, if the downhole calculation is determined to be incorrect, then coefficients are recalculated 424 to calculate a new correction factor. The correction factor is calculated using measured casing collar depth 412, time, and calculated casing collar depth 413. Examples of equations that can be used to calculate the correction factor are given below:

Calculate Gravity:

Gravity=pow(pow(Acc*X*, 2)+pow(Acc*Y*, 2)+pow(Acc*Z*, 2),0.5)

Calculate Speed:

Speed=0.5*pow(Gravity, 2.0)*pow(intTime, 2.0)

Calculate Time Difference (Delta Time):

Time of measured casing collar depth−time of previous measured casing collar depth Measured Casing Length:

Measured casing collar depth−previous measured casing collar depth

Calculated Casing Length:

Calculated casing collar depth−previous calculated casing collar depth

Actual Casing Length:

Expected casing collar length−previous casing collar length

Actual Speed(for Use when Measured Speed is Determined to be Inaccurate):

Actual casing length/Delta time

Actual speed (for Use when Measured Speed is Determined to be Accurate):

Calculated casing length*measured speed/Actual casing length

Correction Factor (Simplified):

(Actual speed/Calculated speed)−1

Corrected Speed:

Corrected speed=Speed*(1+correction factor)

Simplified examples of correction factors and corrected speeds as determined using the equations above, are provided in the tables below:

| Expected depth | Measured depth | Calculated depth | Measured speed | Calculated speed | Correction factor | Corrected speed |
|---|---|---|---|---|---|---|
| 40 | 40 | 40 | 100 | 100 | 0.0000 | 100 |
| 80 | 80 | 80 | 100 | 100 | 0.0000 | 100 |
| 120 | 120 | 120 | 100 | 100 | 0.0000 | 100 |
| 200 | 200 | 200 | 100 | 100 | 0.0000 | 100 |
| 200 | 200 | 200 | 100 | 100 | 0.0000 | 100 |
| 240 | 240 | 240 | 100 | 100 | 0.0000 | 100 |
| 280 | 280 | 280 | 100 | 100 | 0.0000 | 100 |
| 320 | 320 | 320 | 100 | 100 | 0.0000 | 100 |
| 360 | 360 | 360 | 100 | 100 | 0.0000 | 100 |

All measurements agree
No correction is made

| Expected depth | Measured depth | Calculated depth | Measured speed | Calculated speed | Correction factor | Corrected speed |
|---|---|---|---|---|---|---|
| 40 | 38 | 40 | 95 | 100 | 0.0000 | 100 |
| 80 | 76 | 80 | 95 | 100 | 0.0000 | 100 |
| 120 | 114 | 120 | 95 | 100 | 0.0000 | 100 |
| 200 | 152 | 200 | 95 | 100 | 0.0000 | 100 |
| 200 | 190 | 200 | 95 | 100 | 0.0000 | 100 |
| 240 | 228 | 240 | 95 | 100 | 0.0000 | 100 |
| 280 | 266 | 280 | 95 | 100 | 0.0000 | 100 |
| 320 | 304 | 320 | 95 | 100 | 0.0000 | 100 |
| 360 | 342 | 360 | 95 | 100 | 0.0000 | 100 |

Calculated speed and depth are correct
Measured speed and depth indicate a condition where wireline is stretching
No correction is made

| Expected depth | Measured depth | Calculated depth | Measured speed | Calculated speed | Correction factor | Corrected speed |
|---|---|---|---|---|---|---|
| 40 | 40 | 40 | 100 | 100 | 0.0000 | 100 |
| 80 | 80 | 80 | 100 | 100 | 0.0000 | 100 |
| 120 | 120 | 118 | 100 | 95 | 0.0526 | 100 |
| 200 | 200 | 200 | 100 | 100 | 0.0526 | 100 |
| 200 | 200 | 200 | 100 | 100 | 0.0526 | 100 |
| 240 | 240 | 240 | 100 | 100 | 0.0526 | 100 |
| 280 | 280 | 275 | 100 | 87.5 | 0.1955 | 100 |
| 320 | 320 | 320 | 100 | 100 | 0.1955 | 100 |
| 360 | 360 | 360 | 100 | 100 | 0.1955 | 100 |

Measured speed and depth are correct
Calculated speed at the depth of 120 ft was shallow
Correction factor was calculated and applied to subsequent measurements
Calculated speed at the depth of 280 was shallow
Correction factor was calculated and added to previous correction factor
New correction factor is applied to subsequent measurements In some implementations logging and/or perforating operations as described above and illustrated in FIGS. 1-4 may include the pump down operations with automated monitoring and control of various operational parameters. In at least some embodiments, the pump rate of a pump unit (or units), the line speed for a logging/perforating (L/P) unit, and the line tension for the L/P unit may be automatically monitored and controlled to enable efficient pump down operations. Of course, the automatic monitoring and control of parameters such as the propelling force and rate for advancing the tool string into the borehole, the line speed for a wireline unit, and the line tension for the wireline unit is useful for any wireline tool in which the tool string is conveyed into the borehole (cased or uncased) and where it is desired to coordinate control of both the pumping unit and the feed of the tool on the wireline. Such principles may be applied to any wireline logging tool, and perforating tool string. Although a pumping unit is typical for use in pump down operations, other driving units are known which may be used for advancing wireline tools, such as powered tractors, and it is equally important that the driving force be balanced with wireline speed and wireline tension for such tools also.

A number of implementations have been described. Nevertheless, it will be understood that various modifications may be made. Further, the method 400 may include fewer steps than those illustrated or more steps than those illustrated. In addition, the illustrated steps of the method 400 may be performed in the respective orders illustrated or in different orders than that illustrated. As a specific example, the method 400 may be performed simultaneously (e.g., substantially or otherwise). Other variations in the order of steps are also possible. Accordingly, other implementations are within the scope of the following claims.

What is claimed is:

1. A method of correcting a downhole speed of a tool string moving in a wellbore, said method comprising:

(a) inserting a tool string into a proximal upper end of the wellbore, said tool string comprising:
a cable head connected at a first end to a cable;
a casing collar locator;
an accelerometer;
at least one downhole tool selected from the group consisting of a logging tool and a perforating tool;

(b) spooling out cable at the surface allowing the tool string to move into the wellbore;

(c) obtaining data with an accelerometer and providing said data to a processor that calculates the downhole speed of the tool string based on the data from the accelerometer;

(d) moving the tool string past at least two casing collars and sending data to the processor including the depth of each of the collars and time that the casing collar locator passes each of the casing collars;

(e) calculating by the processor an average tool speed over the interval between collars; and (f) comparing the downhole speed of the tool string as calculated by the processor using the data from the accelerometer to the average tool speed calculated by the processor based on the time and casing collars.

2. The method of claim 1, further comprising determining by the processor that the average calculated downhole tool speed is less than or greater than the speed of the tool string as calculated by the processor using the data from the accelerometer, determining a correction factor, and determining a corrected downhole tool speed.

3. The method of claim 2, wherein the correction factor is calculated using a measured casing collar depth, a time, and a calculated casing collar depth.

4. The method of claim 2, wherein the correction factor is determined in part using a calculation of a gravity coefficient given by the equation: gravity=pow(pow(AccX, 2)+pow(AccY, 2)+pow(AccZ, 2), 0.5).

5. The method of claim 4, wherein the correction factor is determined in part using a calculation of downhole tool given by the equation: speed=0.5*pow(gravity, 2.0)*pow(intTime, 2.0).

6. The method of claim 1, further comprising determining by the processor that the casing collar is recorded at a measured depth where expected, determining a correction factor, and determining a corrected downhole tool speed.

7. The method of claim 1, further comprising determining by the processor that the casing collar at calculated depth is shallower/deeper than expected, determining a correction factor, and determining a corrected downhole tool speed.

8. A method of calculating a downhole speed of a tool string moving in a wellbore, said method comprising:

(a) inserting a tool string into a proximal upper end of the wellbore, said tool string comprising:
a cable head connected at a first end to a cable;
a casing collar locator;
at least one downhole tool selected from the group consisting of a logging tool and a perforating tool;

(b) spooling out cable at the surface allowing the tool string to move into the wellbore;

(c) moving the tool string past at least two casing collars and sending data to a processor including the depth of each of the collars and time that the casing collar locator passes each of the casing collars;

(d) calculating an average tool speed over the interval between collars using the depth Of each of the collars and time that the casing collar locator passes each of the casing collars;

(e) determining that the average tool speed is less than or greater than a measured line speed at the surface;

(f) determining a correction factor; and (g) determining a corrected donwnhole tool speed.

9. The method of claim 8, further comprising determining that a casing collar is recorded at a measured depth where expected, determining a correction factor, and determining a corrected downhole tool speed.

10. The method of claim 8, further comprising determining that a casing collar at calculated depth is shallower/deeper than expected, determining a correction factor, and determining a corrected downhole tool speed.

11. The method of claim 8, wherein the correction factor is calculated using measured casing collar depth, time, and calculated casing collar depth.

12. The method of claim 8, wherein the correction factor is determined in part using a calculation of a gravity coefficient given by the equation: gravity=pow(pow(AccX, 2)+pow(AccY, 2)+pow(AccZ, 2), 0.5).

13. The method of claim 12, wherein the correction factor is determined in part using a calculation of downhole tool speed given by the equation: speed=0.5*pow(gravity, 2.0)*pow(intTime, 2.0).

14. A well logging system, said system including:
a tool string comprising:
a cable head connected at a first end to a cable;
a casing collar locator;
an accelerometer;
at least one downhole tool selected from the group consisting of a logging tool and a perforating tool; and
a processor adapted to:
receive data from the accelerometer and calculate a downhole tool speed, receive data from the casing collar locator including the depth of each of the collars and time when the casing collar locator passes at least two different casing collars, calculate the average downhole tool speed over the interval between collars,
compare the downhole tool speed as calculated by the processor using the data from the accelerometer to the average downhole tool speed calculated by the processor based on the time and casing collar location,
determine that the average calculated downhole speed is less than or greater than down hole speed calculated by the processor using data from the accelerometer,
determine a correction factor, and
determine a corrected downhole tool speed.

15. The system of claim 14, wherein the processor is adapter to determine that the casing collar is recorded at a measured depth where expected.

16. The system of claim 14, wherein the processor is adapted to determine that the casing collar at a calculated depth is shallower/deeper than expected.

17. The system of claim 14, wherein the correction factor is calculated using a measured casing collar depth, a time, and a calculated casing collar depth.

18. The system of claim 14, wherein the correction factor is determined in part using a calculation of a gravity coefficient given by the equation: gravity=pow(pow(AccX, 2)+pow(AccY, 2)+pow(AccZ, 2), 0.5).

19. The system of claim 18, wherein the correction factor is determined in part using a calculation of downhole tool speed given by the equation: speed=0.5*pow(gravity, 2.0)*pow(intTime, 2.0).

20. A well logging system, said system including:
a tool string comprising:
a cable head connected at a first end to a cable;
a casing collar locator;
at least one downhole tool selected form the group consisting of a logging tool and a perforating tool; and
a processor adapted to:
receive data from the casing collar locator including the depth of each of the collars and time when the casing collar locator passes at least two different casing collars,
calculate an average downhole tool speed over the interval between collars
determine that the average calculated downhole tool speed is less than or greater than a measured line speed at the surface,
determine a correction factor and,
determine a corrected downhole speed.

21. The system of claim 20, wherein the processor is adapted to determine that the casing collar is recorded at a measured depth where expected, determining a correction factor, and determining a corrected downhole tool speed.

22. The system of claim 20, wherein the processor is adapted to determine that the casing collar at calculated depth is shallower/deeper than expected, determining a correction factor, and determining a corrected downhole tool speed.

23. The system of claim 20, wherein the correction factor is calculated using measured casing collar depth, time, and calculated casing collar depth.

24. The system of claim 20, wherein the correction factor is determined in part using a calculation of a gravity coefficient given by the equation: gravity=pow(pow(AccX, 2)+pow(AccY, 2)+pow(AccZ, 2), 0.5).

25. The system of claim 24, wherein the correction factor is determined in part using a calculation of downhole tool speed given by the equation: speed=0.5*pow(gravity, 2.0)*pow(intTime, 2.0).

* * * * *

UNITED STATES PATENT AND TRADEMARK OFFICE

CERTIFICATE OF CORRECTION

PATENT NO. : 8,875,785 B2
APPLICATION NO. : 14/236044
DATED : November 4, 2014
INVENTOR(S) : Randolph S. Coles It is certified that error appears in the above-identified patent and that said Letters Patent is hereby corrected as shown below:

IN THE CLAIMS:

Column 11, Line 16, replace "Of" with -- of --

Column 11, Line 22, replace "donwhole" with -- downhole --

Column 12, Line 36, replace "collars" with -- collars, --

Signed and Sealed this
Seventeenth Day of March, 2015

Michelle K. Lee

Michelle K. Lee
*Director of the United States Patent and Trademark Office*